United States Patent [19]

Tack

[11] 4,405,081

[45] Sep. 20, 1983

[54] RAIL FASTENER WITH GAUGE ADJUSTMENT

[75] Inventor: Carl E. Tack, Elmhurst, Ill.

[73] Assignee: TransDyne, Inc., Chicago, Ill.

[21] Appl. No.: 341,305

[22] Filed: Jan. 21, 1982

[51] Int. Cl.[3] ..... E01B 9/38; E01B 9/48; E01B 9/66

[52] U.S. Cl. ..... 238/282; 238/283; 238/304; 238/349

[58] Field of Search ..... 238/282, 283, 304, 341, 238/347, 349

[56] References Cited

U.S. PATENT DOCUMENTS

| | | | |
|---|---|---|---|
| 833,007 | 10/1906 | Slick | 238/341 |
| 2,057,963 | 10/1936 | Maney | 238/349 X |
| 2,132,571 | 10/1938 | Maney | 238/349 X |
| 3,460,756 | 8/1969 | Sanson | 238/349 X |
| 3,463,394 | 8/1969 | Jones et al. | 238/349 X |
| 3,700,167 | 10/1972 | Jennings et al. | 238/349 |
| 4,047,663 | 9/1977 | Reynolds et al. | 238/283 X |
| 4,150,791 | 4/1979 | Reynolds et al. | 238/282 |

FOREIGN PATENT DOCUMENTS

| | | | |
|---|---|---|---|
| 531325 | 8/1955 | Italy | 238/347 |

*Primary Examiner*—Robert B. Reeves
*Assistant Examiner*—Howard Beltran
*Attorney, Agent, or Firm*—Gary, Juettner & Pyle

[57] ABSTRACT

A rail fastener having provision for rail gauge adjustment comprises a pair of supports secured to the railway tie in a spaced relation on either side of the base of the rail and a spacer between each support and the rail base. A series of different width spacers are provided for exchangeable insertion between the rail base and support to allow lateral incremental shifting of the rail in the event that gauge adjustment is required. Resilient clips attached to the supports serve to hold down the rail between the spacers, and the dimensions of the spacers are also selected to provide constant deflection of the clips regardless of the adjusted position of the rail.

3 Claims, 5 Drawing Figures

RAIL FASTENER WITH GAUGE ADJUSTMENT

BACKGROUND OF THE INVENTION

This invention relates to a rail fastener arrangement for holding a rail onto a support structure while providing a simple and reliable means to allow lateral adjustment of the rail as may be required in gauge adjustment, i.e., moving the rails closer to each other as the rails become worn or the track settles.

Recent track structures have utilized reinforced concrete ties to support the rails. These ties are preformed with a pair of supports, or shoulders, on each side of the tie, the supports being anchored to the concrete and hence unmovable. A resilient clip is disposed under tension between each shoulder and the adjacent tapered base flange of the rail, in order to hold the rail down on the tie. In addition, a spacer, normally composed of non-conductive material, is disposed between the shoulder and the edge of the rail base to locate the rail centrally between the shoulders and to prevent lateral shifting of the rail on the tie. The spacer may also serve as an insulator between the rails and the supporting track structure in cases where the rails are used to conduct electrical signals. A track structure of the foregoing nature is shown, for example in U.S. Pat. No. 3,700,167.

A common feature in railway track systems is the inclusion of some means to adjust the gauge, or the distance between the centers of the rails. New rails wear primarily on their inside surfaces, which, in effect, causes an increase in gauge. Thus, it is desirable to provide a means for laterally shifting the rails toward each other to bring the rails back into proper gauge. When the rails become excessively worn and no further gauge adjustment is possible, it is also desirable to install new rails and return the gauge to standard.

United Kingdom publication No. 2,010,945 A describes gauge adjustment means that is particularly suitable for use with concrete ties having fixed rail anchor points. A gauge adjustment collar fits around each shoulder and has different thickness walls on each side. To effect a rail adjustment, the outer collar is positioned to dispose a thicker wall between the shoulder and the rail, and the inner collar is positioned to dispose a thinner wall between the other shoulder and the other side of the rail. A second collar is disposed over the first to provide height control and proper tension on the resilient clip in the event the rail is shimmed from underneath.

Another type of gauge adjustment system is shown in U.S. Pat. Nos. 4,047,663 and 4,150,791 which comprise a rotatable eccentric in bearing engagement with a plate supporting the rail. Although such arrangement may provide for simple gauge adjustments, numerous modifications and special parts are required in conventional type track structure, and stresses on the eccentric may cause unintentional rotation and loss of gauge.

SUMMARY OF THE INVENTION

In accordance with the present invention, spacers of unitary configuration are provided, which are intended to replace the insulators or spacers in conventional use. The spacers extend between the shoulder and rail base for lateral support and also extend over the sloping flange of the rail base to provide bearing support for the clip. A series of at least three different exchangeable spacers are provided, each having different base thicknesses, which allows the spacers to be used in various combinations to effect adjustments in the gauge. In addition, the thickness of the portion of the spacer overlying the rail flange varies from spacer to spacer to compensate for the effective height of the sloping rail flange at each lateral position of the rail. This allows a constant force or degree of deflection to be imposed on a standard rail clip regardless of the spacer that is used.

An important advantage of the present invention is that the spacers or insulators have the same general shape as those used on existing conventional track systems and therefore do not require the use of any special, additional, or specially shaped parts that would unnecessarily increase cost and usefulness of a gauge adjustment device.

Additional features and advantages of the invention will become apparent in the following description.

THE DRAWINGS

DESCRIPTION OF THE PREFERRED EMBODIMENTS

Figure 1:
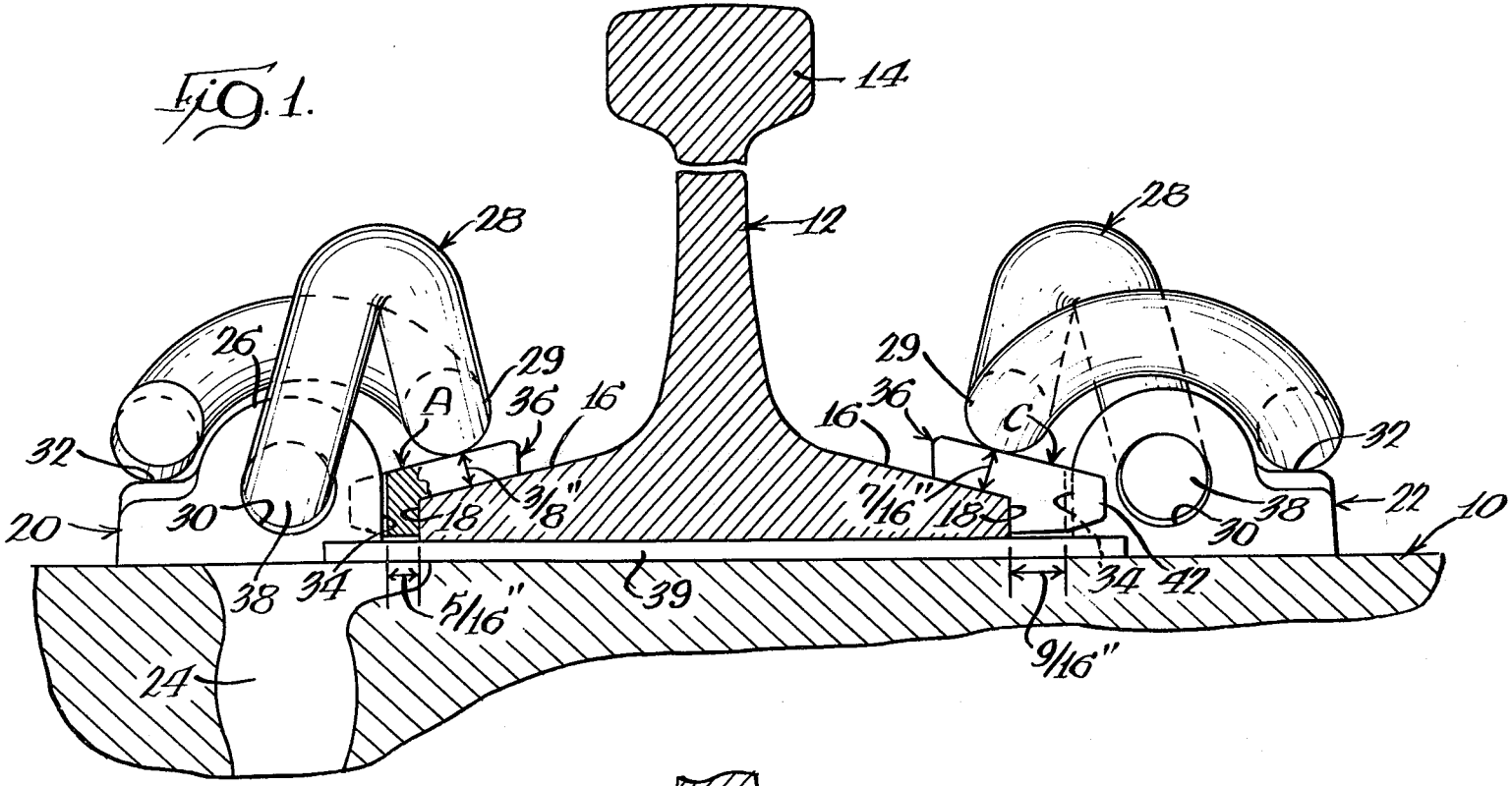
FIG. 1 is an elevational view, partly in cross section, illustrating a railway rail fastener system utilizing the rail gauge adjustment means of the present invention.

FIG. 1 illustrates a permanent rail system similar to that in current use wherein reinforced concrete, such as a slab or a tie 10 as shown, is utilized in lieu of wood ties to support a rail 12. The rail 12 as shown is of conventional design and includes an upper enlarged portion 14 on which the train wheels ride, and an enlarged base having a downwardly sloping wall 16 terminating at shoulders 18.

Means are provided to hold the base of the rail to the tie and to prevent lateral movement. As shown, spaced supports 20 and 22, sometimes referred to as shoulders, are provided at a spaced location from respective sides of the rail base. Each support comprises a downwardly depending anchor 24 embedded in the concrete tie 10 and an enlarged upper portion or head 26 resting on the upper surface of the tie. The head 26 includes features for receiving a resilient clip 28 including an aperture 30 in the head extending parallel to the longitudinal axis of the rail, and a horizontal shoulder 32 on the outer side of the head to provide bearing support for one end of the clip. The inner side of the head includes a substantially flat vertical wall 34 for supporting one side of a spacer 36 retained between the supports 20 and 22 and the shoulder 18 at the base of the rail. The spacer 36 also extends upward over a portion of the sloping wall 16 of the rail base and provides bearing support for the other side of the resilient clip 28.

The foregoing rail support system is conventional in nature and is sold under the trademark "PANDROL." The resilient clip 28 includes a central leg 38 that is driven into the aperture 30, causing the opposite sides to be placed under downward tension, such that the rail is resiliently restrained downwardly, with sideways movement being restrained by the spacers 36. Typically, the spacers are made from an electrically non-conductive material and serve as an insulator between the rail 12 and its support structure. In the alternative, the spacers 36 may be composed of metal in situations where insulation is not required. In addition, a flexible, non-conductive pad 39 is typically provided between the lower surface of the rail and the upper surface of the tie to absorb vibrations and insulate the rail.

Figure 4:
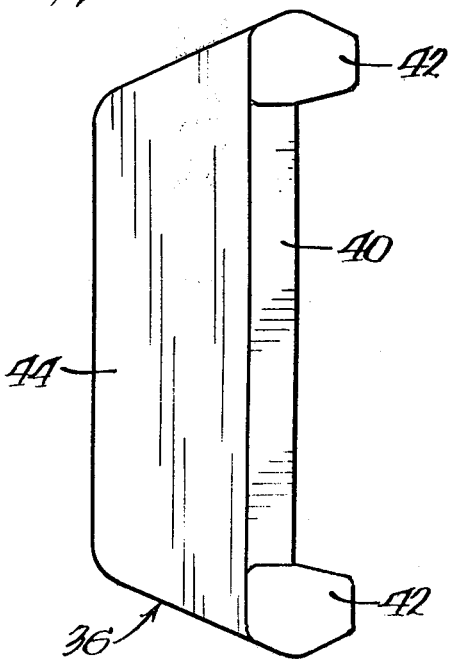
FIG. 4 is a perspective view of a typical spacer used in connection with the present invention.
Figure 5:
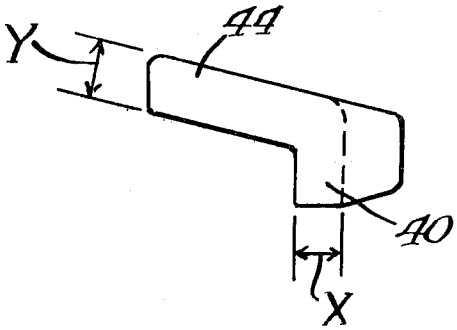
FIG. 5 is an end view of the spacer shown in FIG. 4.

The spacer 36 is shown in detail in FIGS. 4 and 5, wherein it will be noted that each spacer is a unitary body having a vertical wall 40 adapted to abut the vertical wall 34 of the supports 20 and 22. The wall 40 also includes a pair of lugs 42 properly spaced to embrace the side surfaces of the supports. A relatively inclined wall 44 slopes upwardly from wall 40 for bearing against the inclined surface 16 of the rail base.

In accordance with the present invention, a series of individual spacers 36 are provided to permit adjustment of the gauge, with each member of the series having a different size as will be herein described. For the purposes of the present description, three differently sized spacers, identified in FIGS. 1–3 as A, B and C will be described, although additional members could be incorporated into the series. Also, for the purposes of the present description, it will be assumed that the outer end of the tie is to the left of FIGS. 1–3, with gauge adjustments being made toward the right of these figures.

With reference to FIG. 5, and FIGS. 1–3, the thickness (X) of the spacer wall 40, which spaces the support 20 from the base of the rail, is different with each member of the series of spacers. As illustrated, the spacers A have the narrowest wall at dimension X of, for example, 5/16 inch, the same wall in the spacers B have an intermediate thickness of, for example, 7/16 inch, and the spacers C may have the greatest wall thickness of, for example, 9/16 inch.

Figure 2:
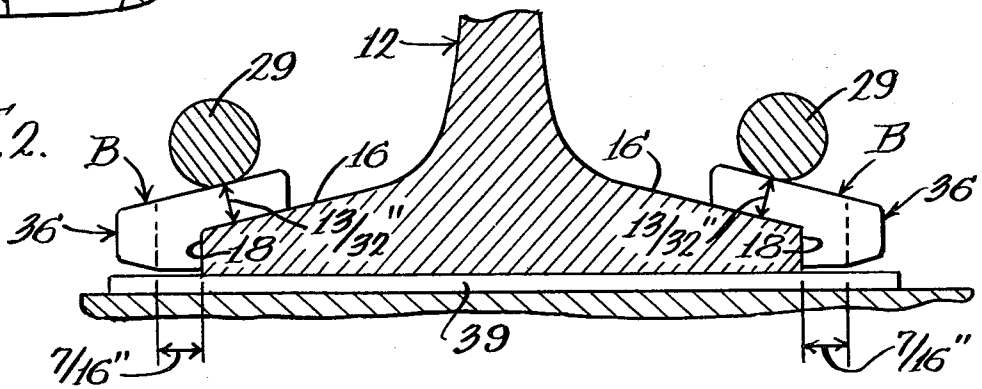
FIGS. 2 and 3 are views similar to FIG. 1, with certain parts removed for the sake of clarity, illustrating different dimensioned spacers to provide successive rail gauge adjustment from the initial position shown in FIG. 1.
Figure 3:
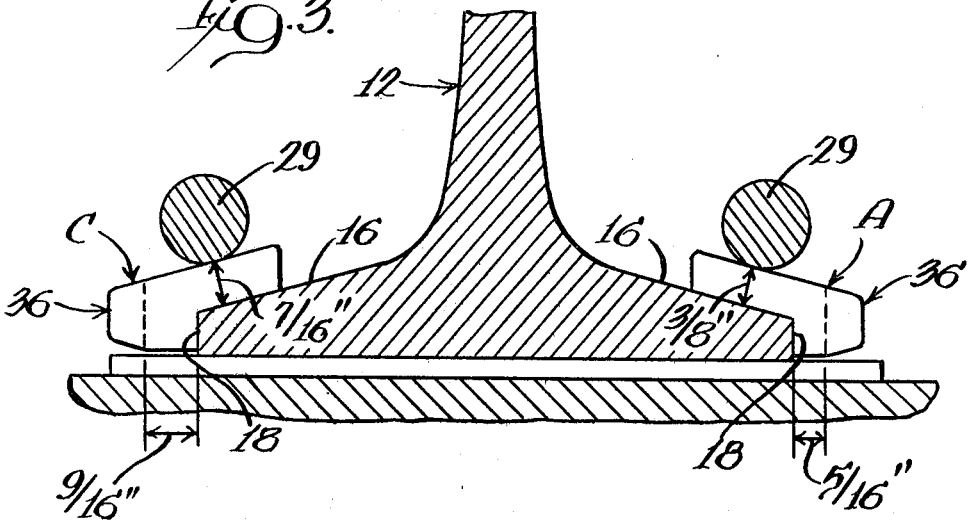

From the examples given above, and in viewing the left hand portions of FIGS. 1–3, it may be seen that as the spacers are progressively inserted in the series A, B and C, the rail is displaced inwardly corresponding to the increased wall thicknesses. Thus, referring to the previous examples, replacing spacer A with spacer B (FIG. 2) will effect a $\frac{1}{8}$ inch adjustment, and insertion of spacer C (FIG. 3) will effect an additional $\frac{1}{8}$ inch adjustment inwardly.

The corresponding wall thickness (X) of the spacers used will become progressively thinner as the other side becomes thicker, and it will be appreciated that the sum of the thickness of the two walls will necessarily be constant, since the distance between the opposed supports 20 and 22 is fixed. Thus, the track will be originally installed with an A spacer on the outside and a C spacer on the inside. The first gauge adjustment will use spacers B-B and the second adjustment will use spacers C–A.

As a further example of a series of four spacers, W, X, Y and Z having progressively increasing wall thicknesses, the following combinations would be used W-Z, X-Y, Y-X and Z-W, i.e., the set on one side would be used with the set in reverse on the other side. To facilitate installation, the members of the series could be color coded or otherwise marked to indicate proper combinations.

The walls 44 of the members of each series are also dimensioned to provide a substantially constant height of engagement between the top surface of the tie and the point at which the inside leg 29 of the clip 28 contacts the upper surface of the wall 44 when the clip in under tension. As the rail 12 is adjusted to the right, as shown in FIGS. 1–3, it may be seen that the thickness of the sloping rail base becomes progressively thinner relative to the fixed position of the clip leg 29. Thus, it is desirable to provide successive increases in thickness of the wall 44 (dimension Y in FIG. 5) so that a constant deflection or toe load exists between the clip and the rail. In summary, as the thickness of the walls 40 and 44 are progressively increased between successive members of the series of spacers on the outside as the rail gauge is adjusted inwardly.

From the foregoing, it may be seen that the present invention provides a simple and convenient method for adjusting the gauge of a rail that is retained on a tie between a pair of support structures having a fixed distance therebetween, since the supports 20 and 22 are permanently affixed in the structure as shown and are not movable. Except for the specially dimensioned spacers and the combinations thereof which are employed, the rail support structure may employ conventional parts without any undue modification thereto.

I claim:

1. In a rail securing system wherein the rail has a flanged base resting on a tie between space supports, and a spacer is provided between each support and the rail, and wherein a resilient retainer extends from each support for holding down the fanged base of the rail, the improvement for providing successive changes in the lateral position of the rail relative to the supports, said improvement comprising a set of individual spacers including a plurality of members, said spacers being substitutable for one another between the rail and said supports, with each of said spacers comprising a base located between the support and the base of the rail, and a portion extending from said spacer base overlapping the flanged base of the rail, the thickness of the base of each member being different, and the sum of the thicknesses of any selected pair of spacer bases being constant, said resilient retainer engaging the overlapping portion of said spacer, said overlapping portion having different thicknesses within each set, whereby to provide constant deflection of the resilient retainers regardless of the adjusted position of the flanged rail base.

2. The improvement of claim 1 wherein the thickness of the overlapping portion increases with the thickness of the spacer.

3. The improvement of claim 1 wherein said pair of spacers being employed corresponds to one member selected in numerical order of the set arranged in increasing order of thicknesses, and the other member selected in the same numerical order of the set arranged in decreasing order of thicknesses.

* * * * *